US005199120A

United States Patent [19]

Holmes

[11] Patent Number: 5,199,120

[45] Date of Patent: Apr. 6, 1993

[54] PORTABLE COMBINED LOUGING MAT AND PILLOW HAVING A POCKET

[76] Inventor: Terrance F. Holmes, 2733 Adriatic Way, Sacramento, Calif. 95826

[21] Appl. No.: 890,649

[22] Filed: May 28, 1992

[51] Int. Cl.[5] ..... A47G 9/06

[52] U.S. Cl. ..... 5/419; 5/417; 5/485; 190/2

[58] Field of Search ..... 5/417–420, 5/485; 383/4; 190/1, 2

[56] References Cited

U.S. PATENT DOCUMENTS

| | | | |
|---|---|---|---|
| 1,930,942 | 10/1933 | Pringle | 5/419 |
| 2,105,319 | 1/1938 | Hedden | 5/419 |
| 4,068,786 | 1/1978 | Taniguchi | 5/419 |
| 4,154,323 | 5/1979 | Sneider . | |
| 4,188,988 | 2/1980 | Agyagos | 383/4 |
| 4,195,378 | 4/1980 | Parker | 5/419 |
| 4,516,668 | 5/1985 | Grayek . | |
| 4,634,618 | 1/1987 | Greer et al. . | |
| 4,654,907 | 4/1987 | Haugaard . | |
| 4,905,990 | 3/1990 | DeSantis . | |
| 4,967,986 | 11/1990 | Schildkraut . | |
| 4,984,906 | 1/1991 | Little . | |
| 4,991,245 | 2/1991 | Franco . | |
| 5,022,107 | 6/1991 | Knotts . | |

FOREIGN PATENT DOCUMENTS

| | | | |
|---|---|---|---|
| 28323 | 8/1931 | Australia | 5/419 |
| 439420 | 7/1991 | European Pat. Off. | 5/419 |
| 761135 | 6/1934 | France | 5/419 |
| 1215109 | 4/1960 | France | 383/4 |
| 211727 | 2/1924 | United Kingdom | 5/419 |

*Primary Examiner*—Michael F. Trettel
*Assistant Examiner*—F. Saether
*Attorney, Agent, or Firm*—James M. Ritchey

[57] ABSTRACT

Provided is a portable combination lounging mat and pillow comprising a pillow adapted to provide both a cushioned support for a user and a form around which the mat wraps for transportation and storage. The front and back surfaced mat, with extending side flaps for enlarging the usable mat surface area when opened, is secured to the pillow. Within the mat is at least one storage compartment with a mat front surface entrance for use when the mat is opened and a mat back surface entrance for accessing the storage compartment when the mat is wrapped for transportation and storage.

6 Claims, 4 Drawing Sheets

PORTABLE COMBINED LOUGING MAT AND PILLOW HAVING A POCKET

BACKGROUND OF THE INVENTION

1. Field of the Invention

A portable lounge device is related. Specifically, a compatible combination mat and pillow lounge is described that includes means for internally storing items, wherein the storage means is readily accessible by a user when the device is in either an open or closed configuration.

2. Description of the Background Art

Blankets and general purpose ground cloths have been used for protecting loungers from different undesirable conditions of the ground, be it dirt, grass, cement, sand, a deck, and the like. Folding and transporting these items and associated pillows and similar belongings is often inconvenient. Unorganized items are usually bulky and require undue effort to move and use.

Specifically, U.S. Pat. No. 4,154,323 teaches a multipurpose carrying bag for holding diapers and other baby supplies. A detachable strip of material is included, as is a surrounding bag. Several pouches are accessible only from outside the bag.

A knock-down combination handbag and mat and method of making the same is related in U.S. Pat. No. 4,516,668. The mat folds into a compact volume and then is inverted into a a receiving pouch, thereby generating a handbag.

Described in U.S. Pat. No. 4,634,618 is a weighted towel. Around the perimeter of the towel is a weighted cord. The towel is secured to a receiving stuff bag with a drawstring.

U.S. Pat. No. 4,654,907 presents a folding recreation chair-pad. Several rectangular components are secured to a surrounding fabric. The components are related to one another to produce a back support and sitting cushion. The components collapse and fold together to generate a suitcase-like piece of luggage.

An exercise mat is provided in U.S. Pat. No. 4,905,990. Two main members comprise the device, a main mat and an extension mat. A pocket is included to store the extension pad to the main pad.

A carry-all for transporting articles including a towel to a bathing area is disclosed in U.S. Pat. No. 4,967,986. for transportation, an elongated pad is rolled into a cylinder and secured by VELCRO TM fasteners. A handle and storage pockets, accessible only from the unrolled device, are provided.

A multi-purpose utility tote is related in U.S. Pat. No. 4,984,906. The entire structure is secured in a closed form by means of a zipper around the perimeter of the main panels. The closed structure has a shape of a cubic container or box with an inner open volume for storage. Unfolded, the device consists of the several interconnected main panels an several interconnected and extendible side panels for generating a ground covering surface. Provided are an outer pocket and a detachable inner pocket.

U.S. Pat. No. 4,991,245 describes a portable pillow/-lounge set that is convertible into and from a tote bag. A rectangular member has a pillow incorporated into one end. The device folds upon itself to produce a bag with handles and an internal storage compartment.

U.S. Pat. No. 5,022,107 teaches a beach mattress. An elongated, rectangular pad is provided with a plurality of item holding members and a pillow. The pad rolls to a transportation size.

The subject device overcomes limitations existing in the prior art by providing a portable mat and pillow lounge that has storage means accessible from either an open or closed configuration. Pockets are included that are readily accessed when the mat is rolled about the pillow and when the mat is lying upon the ground. Additionally, a generous pillow is supplied that serves a duel role of giving the user a cushion and as a form upon which to wrap the mat to generate a convenient suitcase-like portable unit.

SUMMARY OF THE INVENTION

An object of the present invention is to disclose an easily portable combination pillow and mat for lounging at a beach, pool, or the like.

Another object of the present invention is to provide a portable lounging pillow and mat combination that includes a storage compartment that is accessible when the mat is either opened or closed.

A further object of the present invention is to produce a portable lounging combination pillow and mat that is adapted for wrapping the mat around the pillow for transportation and storage and includes means for securing the mat in the wrapped form and for carrying the subject invention.

Disclosed is a portable combined lounging mat and resilient pillow comprising a rectangular suitcase-shaped pillow. The pillow has distal, proximal, and opposing side borders and front and back surfaces. The resilient cushion has a thickness between the front and the back surfaces and is adapted to provide both a cushioned support for a user and a form around which the mat wraps for transportation and storage.

Comprising the mat is a rectangular central panel with front and back surfaces that has first and second ends and opposing first and second edges. The central panel first end is secured proximate the pillow proximal border. Included in the subject invention is a rectangular first side panel with front and back surfaces and opposing first and second edges. The central panel first edge is secured to the first side panel first edge. Also, provided is a rectangular second side panel with front and back surfaces and opposing first and second edges. The central panel second edge is secured to the second side panel second edge.

Further, incorporated in the subject invention is a storage compartment associated with the central panel. The storage compartment is located within the mat between the central panel frond and back surfaces and is proximate the central panel second end. A first sealable entrance is associated with the central panel front surface for accessing the storage compartment when the mat is unrolled or unwrapped. A second sealable entrance is associated with the central panel back surface for accessing the storage compartment even when the mat is in a closed transportation and storage configuration when the mat is wrapped around the pillow form.

Preferably, means are associated with the central panel back surface for securing reversibly the mat in a closed transportation and storage configuration. Usually, the mat securing means comprises a set of straps with interlocking ends.

Other objects, advantages, and novel features of the present invention will become apparent from the detailed description that follows, when considered in conjunction with the associated drawings.

DESCRIPTION OF THE PREFERRED EMBODIMENT

Figure 1:
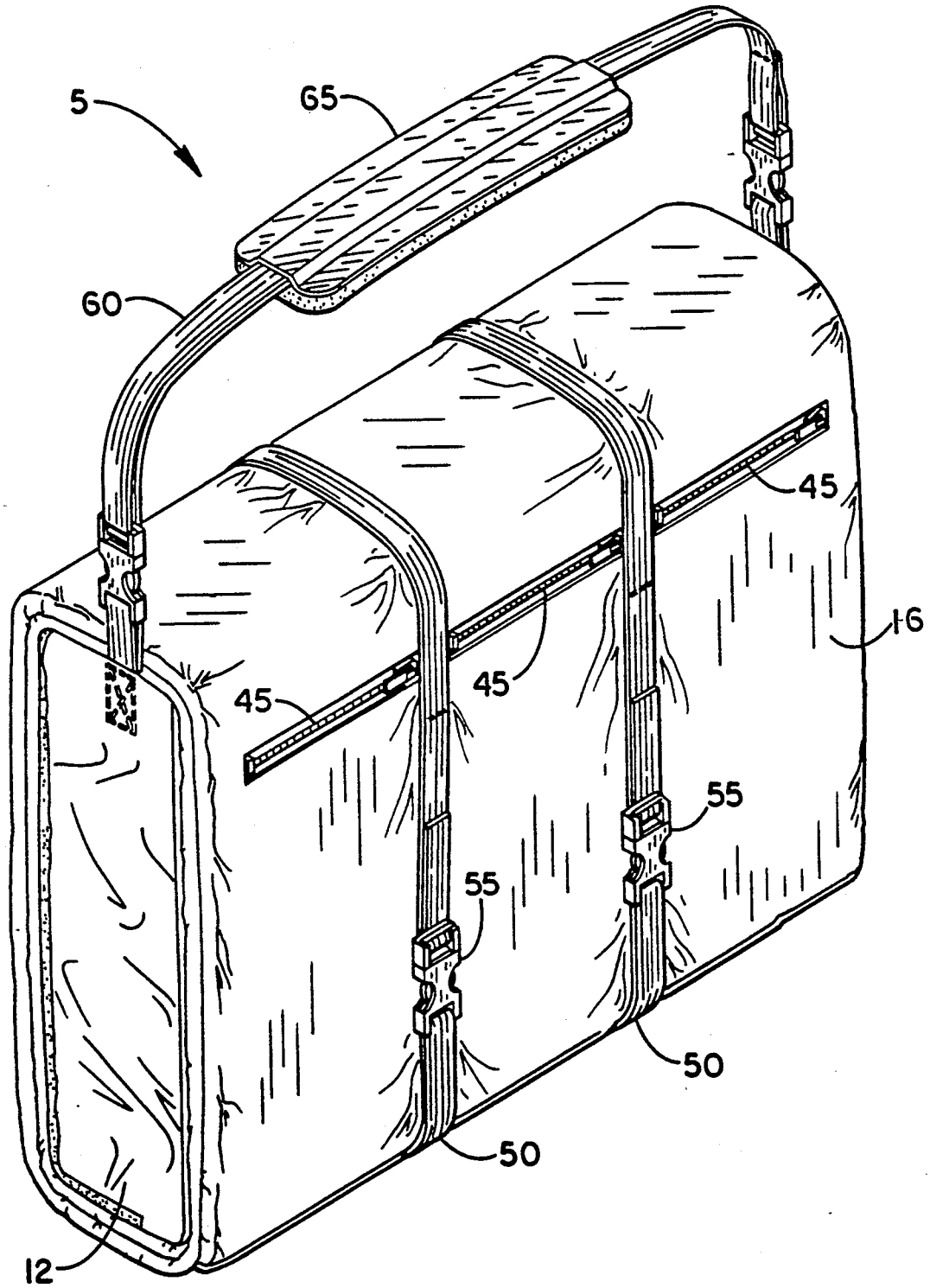
FIG. 1 is a perspective view illustrating the closed form of the subject invention.
Figure 2:
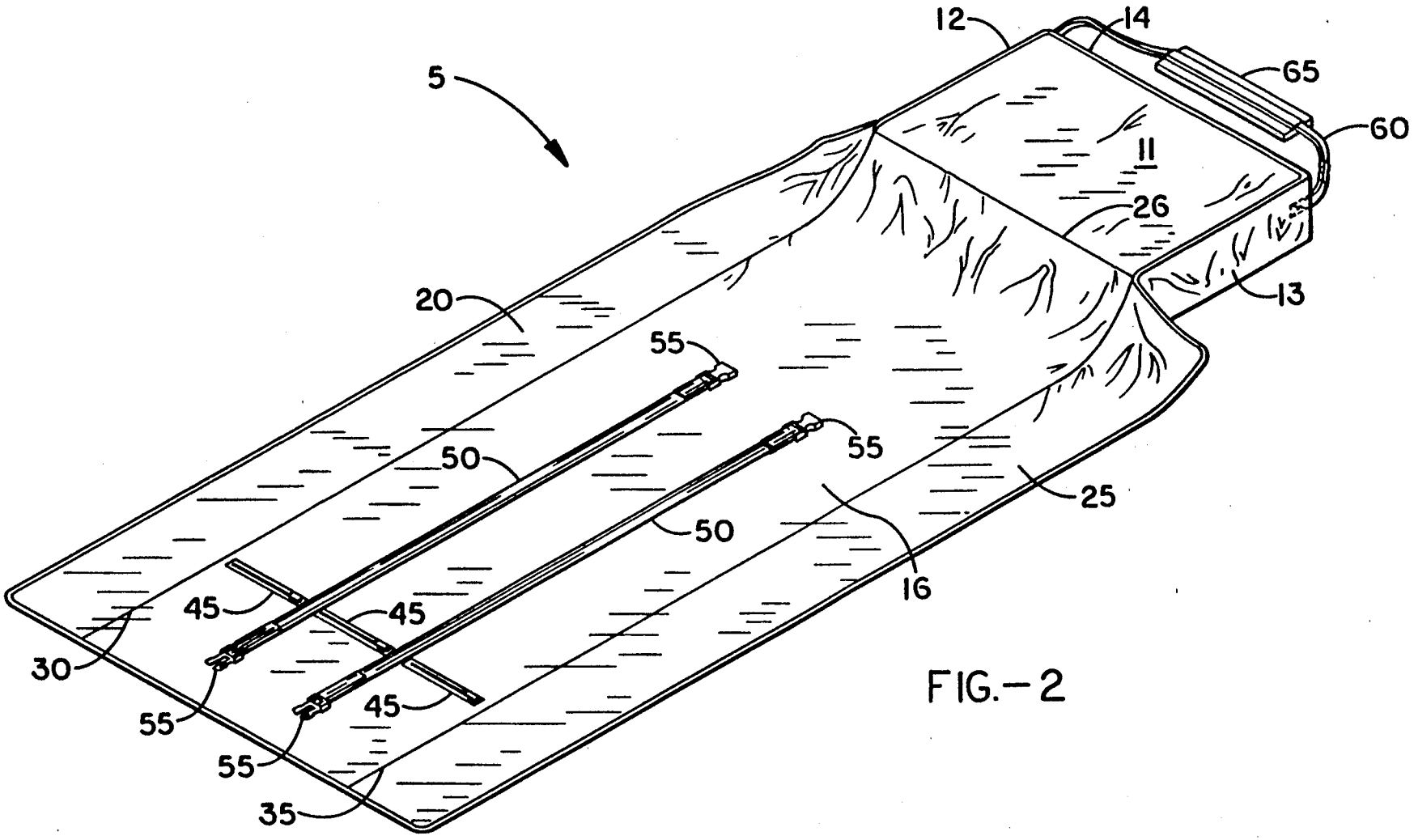
FIG. 2 is a perspective view of the back side of the opened subject invention.
Figure 3:
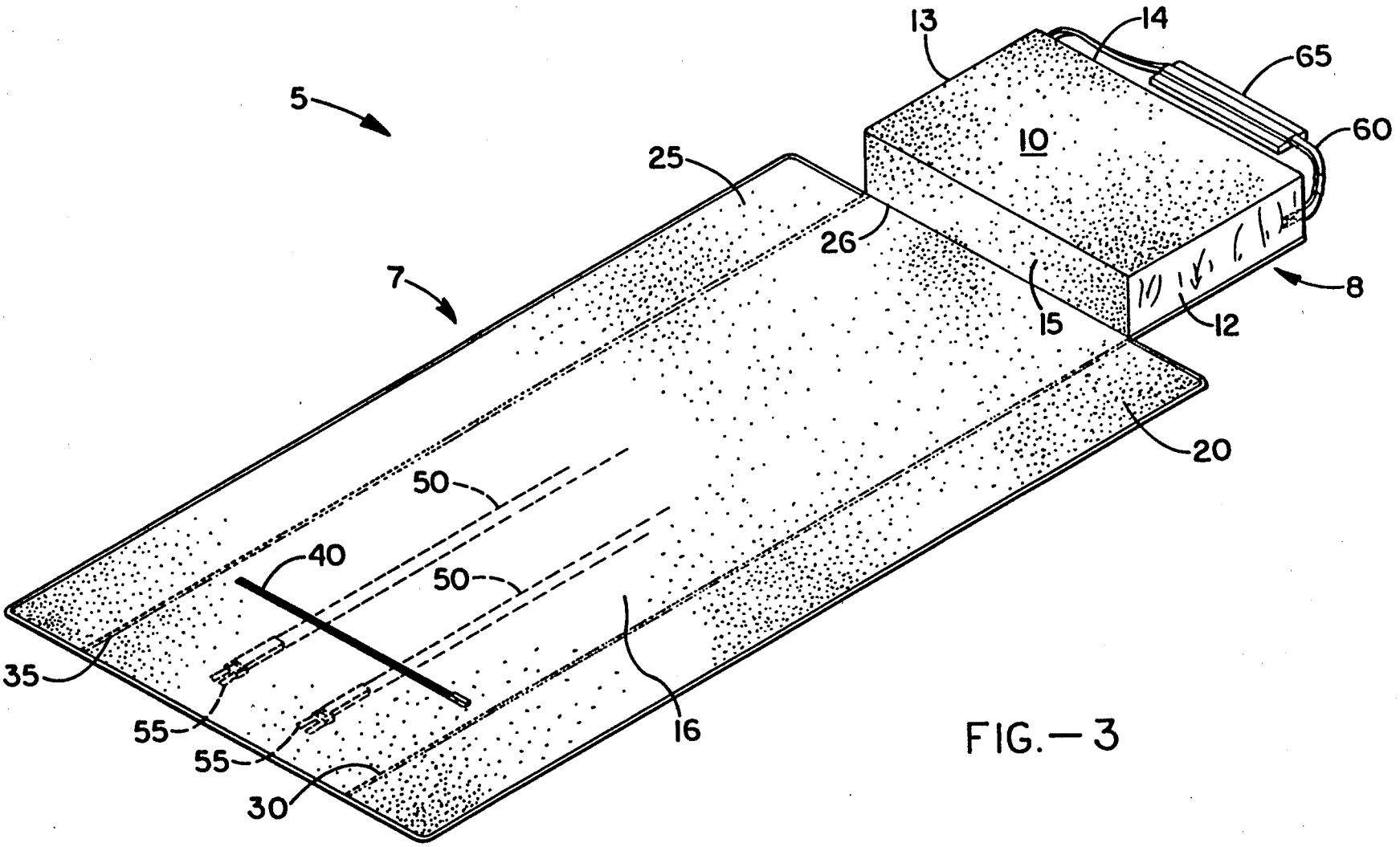
FIG. 3 is a perspective view of the front side of the opened subject invention.

Referring now to FIGS. 1–4, there is shown a preferred embodiment of a combination pillow and mat lounge 5. The subject lounge 5 is stored or carried in a lightweight and compact form shown in FIG. 1. When utilized for lounging by a pool or a beach, on a boat, or the like by a user, a mat 7 portion of the apparatus 5 unwraps from around a pillow 8 to produce an underlying surface covering.

The pillow 8 comprises a front surface 10, a back surface 11, first 12 and second 13 opposing side borders, a distal border 14, and a proximal border 15. Usually, the pillow 8 has an external cover and a removable internal cushion, but the cover and cushion may be fused or combined into a single pillow unit. Although the shape of the pillow 8 is variable, usually, the pillow 8 is a rectangular, suitcase-shaped or box-shaped structure.

The resilient pillow cushion is generally made of natural or synthetic foam polymer, however, other equivalent materials are acceptable. The pillow cover is normally made of washable fabric like nylon or a similar natural or synthetic material.

Preferably, the mat 7 is a generally rectangular ground cloth fabricated from one or more layers of materials. Normally, to permit folding into a compact structure, the mat 7 is divided into three panels. Therefore, the mat 7 usually comprises a three segment ground covering fabricated from materials that are washable and suitable for resisting wear. Specifically, a generally rectangular central panel 16, comprises first and second ends and opposing first and second edges. Also, generally rectangular first and second side flaps or side panels 20 and 25, each with first and second edges, are secured to the edges of the central panel 16. Specifically, the central panel 16 first edge is secured to the first edge of the side panel 20 and the central panel 16 second edge is secured to a first edge of the side panel 25.

The mat 7 is constructed from a plurality of pieces of fabric. Often the mat 7 and pillow covering are produced from a single large piece of suitable fabric that is stitched into the central panel 16, two side panels 20 and 25, and the pillow covering. Affixing or demarking the central panel 16 to or in relation to the pillow 8 is a connection seam 26 proximate or at the pillow proximal border. The connection seam 26 is produced by stitching, gluing, continuous material fabrication, and equivalent means.

Figure 4:
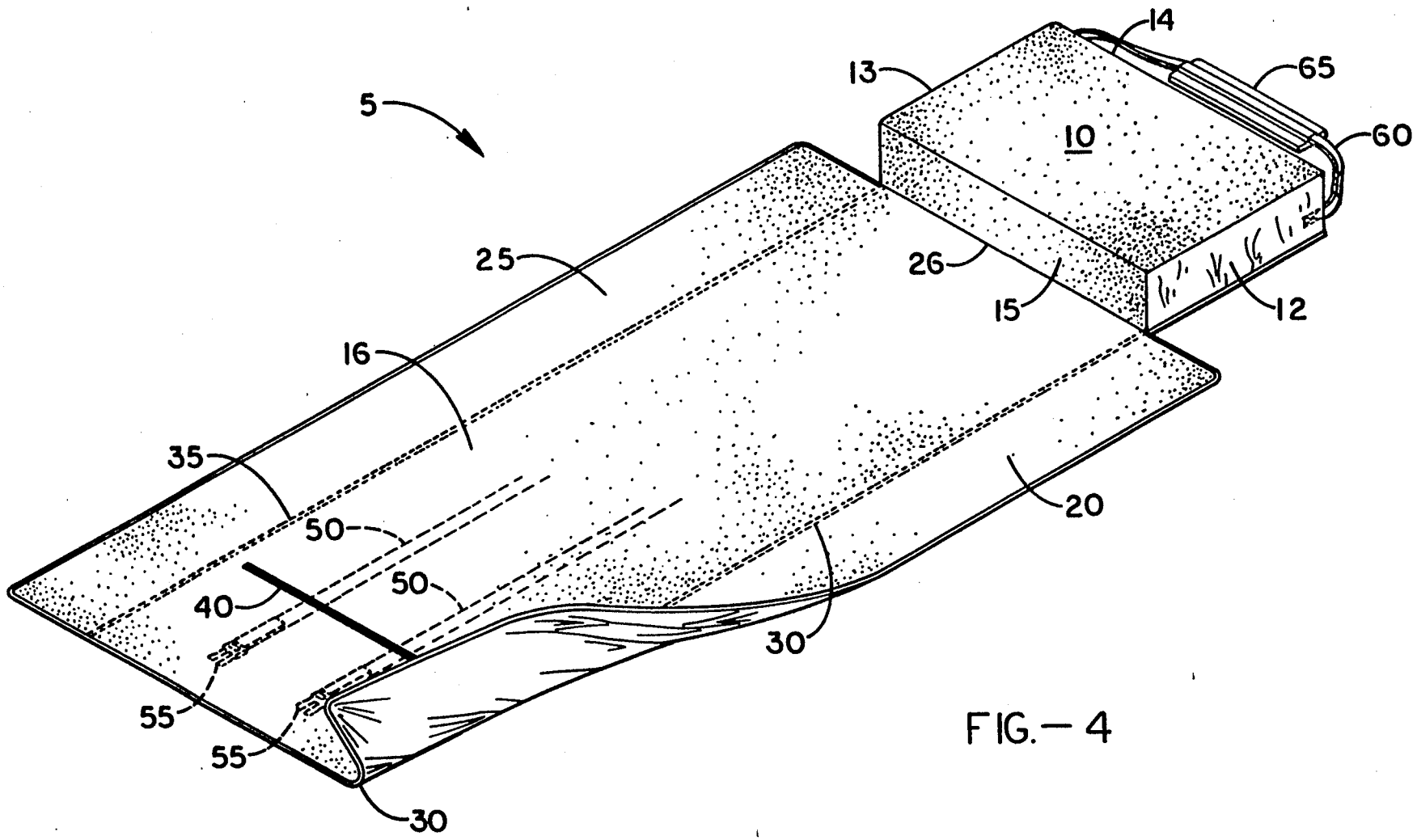
FIG. 4 is a perspective view of the front side of the opened subject invention depicting a flap being folded in over the central panel.

More specifically concerning the side panels 20 and 25 to central panel 16 connections, side panel 20 is secured or linked to the central panel 16 at side panel connection seam 30, as is side panel 25 to the central panel 16 at side panel connection seam 35. Generally, since the mat 7 is often fabricated from an essentially continuous piece of material, the two side panel connection seams 30 and 35 are double stitched, sewn seams, or the equivalent. The double stitching assists a user in folding the side flaps 20 and 25 over the central panel 16 for storage and transportation (the double stitched seams 30 and 35 induce or promote folding of the flaps 20 and 25 over the central panel 16 when the user flips the end of the flaps 20 and 25 towards the central panel 16), as shown in FIG. 4.

The mat 7 has front and back surfaces, as would the comprising central panel 16 and the two side panels 20 and 25. The mat 7, with its component pieces of the central panel 16 and side flaps 20 and 25, is either a single layered sheet of fabric or, preferably, two layers of fabric with a thickness of padding material secured between the two layers. The padding cushions a user from hard or uneven underlying surface features upon which the mat 6 is set. Either attached to the central panel 16 or formed within the central panel 16 is at least one storage compartment with means for accessing the storage compartment from both the mat front and back surfaces. Specifically, the storage compartment accessing means comprises openings, preferably a sealable openings, in both the front 40 and back 45 surfaces of the mat 7. Usually, each storage compartment is located within the central panel 16 proximate the central panel 16 second end or at the foot of the mat 16 at the end opposite the pillow 8. Ordinarily, each storage compartment or pocket extends within the central panel 16 between the foot of the mat and the front and back surface sealable entrances 40 and 45. With this configuration, a user lying on the mat 7 merely opens the sealable entrance on the mat 7 front side 40 to store or remove items from within the storage compartment. The length of the mat 7 and the dimensions of the pillow 8 are selected so that when the mat 7, with the side flaps 20 and 25 folded in, is rolled or wrapped around the pillow 8 each back surface entrance 45 is aligned proximate the upper portion of the suitcase-like compacted subject device (see, FIG. 1). As seen in FIG. 1, three back surface 45 entrances are depicted, but more than or less than three entrances 45 are contemplated. The sealable means on each entrance 40 and 45 includes zippers, VELCRO TM, snaps, buttons, hooks, and the like.

The form of the pillow 8 provides a shape conducive to accessing the storage compartments. When wrapped, the second or foot end of the central panel 16 passes over the distal border 14 of the pillow 8 and then down over the pillow back surface 11. Since the back surface entrances 45 are located in from the mat 7 end, the entrances 45 are positioned near the upper edge of the compacted transportable subject device.

Reversible mat securing means are provided to secure the mat 7 around the pillow 8. Best seen in their open or non-connected forms in FIG. 2, the preferred straps 50 are associated with the central panel's 16 back surface. Two straps 50 are shown in the figures, however, one strap or more than two straps are possible. Each strap 50 may be loose and not directly associated with the mat 7, however, preferably, each strap 50 is secured to the central panel's 16 back surface by appropriate means such as stitching, gluing, and other similar means. Each strap has two ends and usually includes means for adjusting the length of the strap 50.

For fastening each strap 50 in a closed configuration, a coupling means is associated with the strap 50 ends. Although coupling means such as VELCRO TM, hooks, snaps, buttons, and the like are considered within the realm of this disclosure, preferably, the subject device employs interlocking male-female buckles 55, which are depicted in FIGS. 1-4.

Generally, carrying means are included with the subject device. As illustrated in FIGS. 1-4, the preferred carrying means comprises a length adjustable hand or shoulder strap 60 and a padded cushion 65 fitted to or over the shoulder strap 60. Usually, each end of the shoulder strap 60 is reversibly secured to a side of the pillow 8. To reversibly secure the shoulder strap 60 to the pillow 8, the shoulder strap 60 has two opposing ends with each end secured by appropriate means such as male-female buckles (like the ones associated with each closing strap 50), VELCRO TM, snaps, and the like to the pillow 8.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A portable combined lounging mat and pillow, comprising:

a) a pillow having distal, proximal, and opposing side borders and front and back surfaces, wherein said pillow is adapted to have a thickness between said front and back surfaces that provides both a cushioned support for a user and a form around which said mat wraps for transportation and storage;

b) a mat secured to said pillow, wherein said mat has first and second ends and front and back surfaces, wherein said mat first end is secured to said pillow and said ma: wraps around said pillow form for said transportation and storage;

c) a storage compartment associated with said mat proximate said mat second end; and d) means associated with said mat proximate said mat second end for accessing said storage compartment from both said mat front and back surfaces when said mat is in an open form and from said mat back surface when said mat wraps around said pillow form for said transportation and storage.

2. A portable combined lounging mat and pillow according to claim 1, wherein said storage compartment accessing means comprises a sealable opening in said mat front surface and a sealable opening in said mat back surface.

3. A portable combined lounging mat and pillow, comprising:

a) a resilient pillow having distal, proximal, and opposing side borders and front and back surfaces, wherein said pillow is adapted to have a thickness between said front and back surfaces that provides both a cushioned support for a user and a form around which said mat wraps for transportation and storage;

b) a mat comprising:

a rectangular central panel with front and back surfaces and having first and second ends and opposing first and second edges, wherein said central panel first end is secured to said pillow;

a rectangular first side panel with front and back surfaces and having opposing first and second edges, wherein said central panel first edge is secured to said first side panel first edge;

a rectangular second side panel with front and back surfaces and having opposing first and second edges, wherein said central panel second edge is secured to said second side panel first edge;

c) a storage compartment associated with said central panel, wherein said storage compartment is located between said central panel front and back surfaces proximate said central panel second end;

d) means associated with said central panel proximate said central panel second end for accessing said storage compartment from both said central panel front and back surfaces when said mat is in an open form and from said central panel back surface when said mat wraps around said pillow form for said transportation and storage; and e) means associated with said central panel back surface for securing said mat when wrapped around said pillow form.

4. A portable combined lounging mat and pillow according to claim 3, wherein said storage compartment accessing means comprises a sealable opening in said central panel front surface and a sealable opening in said central panel back surface.

5. A portable combined lounging mat and pillow, comprising:

a) a resilient, rectangular box-shaped pillow having distal, proximal, and opposing side borders and front and back surfaces, wherein said pillow is adapted to have a thickness between said front and back surfaces that provides both a cushioned support for a user and a form around which said mat wraps for transportation and storage;

b) a mat comprising:

a rectangular central panel with front and back surfaces and having first and second ends and opposing first and second edges, wherein said central panel first end is secured proximate said pillow proximal border;

a rectangular first side panel with front and back surfaces and having opposing first and second edges, wherein said central panel first edge is secured to said first side panel first edge;

a rectangular second side panel with front and back surfaces and having opposing first and second edges, wherein said central panel second edge is secured to said second side panel first edge;

c) a storage compartment associated with said central panel, wherein said storage compartment is located within said mat between said central panel front and back surfaces and is proximate said central panel second end;

d) a first sealable entrance associated with said central panel front surface proximate said central panel second end for accessing said storage compartment when said mat is in an open form;

e) a second sealable entrance associated with said central panel back surface for accessing said storage compartment even when said mat is in a closed transportation and storage configuration when said mat is wrapped around said pillow form; and f) means associated with said central panel back surface for securing reversibly said mat in a closed transportation and storage configuration when said mat is wrapped around said pillow form.

6. A portable combined lounging mat and pillow according to claim 5, wherein said storage compartment extends within said mat generally between said central panel second end and said first and said second sealable entrances.

* * * * *